United States Patent [19]

Dobinski et al.

[11] Patent Number: 4,727,924

[45] Date of Patent: Mar. 1, 1988

[54] MOLD OSCILLATOR

[75] Inventors: William J. Dobinski, Myrtle Beach; Aubrey K. Rogers, Jr., Georgetown, both of S.C.

[73] Assignee: Georgetown Steel Corporation, Georgetown, S.C.

[21] Appl. No.: 916,591

[22] Filed: Oct. 8, 1986

[51] Int. Cl.[4] ..... B22D 11/04

[52] U.S. Cl. ..... 164/416

[58] Field of Search ..... 164/416, 478

[56] References Cited

U.S. PATENT DOCUMENTS 4,057,099 11/1977 Danieli ..... 164/416

4,274,472 6/1981 Cazaux ..... 164/478

*Primary Examiner*—Nicholas P. Godici

*Assistant Examiner*—Richard K. Seidel

*Attorney, Agent, or Firm*—Ralph H. Dougherty

[57] ABSTRACT

A mold oscillator for a continuous casting machine in which a mold is mounted for vertical reciprocation on a mold table frame, the machine having an enclosed spray chamber beneath the mold for spray cooling of a continuous casting therein as it emerges from the mold, in which an oscillator cam connected to a drive motor is connected through a yoke to first and second vertical shafts fixed to the mold table frame at their upper ends, and are seated within and vertically oscillatable within tubular guide means and ball bushings therein, which control the alignment of the shafts, thus reducing horizontal vibration and strand misalignment.

14 Claims, 3 Drawing Figures

MOLD OSCILLATOR

BRIEF SUMMARY OF THE INVENTION

The present invention relates to the continuous casting of molten metals, and more particularly to apparatus for oscillating or reciprocating the casting mold. Specifically, the invention is a mold oscillating apparatus for the continuous casting of metal into either a straight mold from which the casting moves straight downwardly, or a curved mold wherein the casting emerging from the mold will follow an arcuate path. The invention is described herein with reference to the continuous casting of steel, however, it will be appreciated that the invention can also be used in the continuous casting of other metals.

Molds used for continuous casting were often mounted on springs within a large frame connected to an oscillating mechanism. Both the frame and the mold within the frame required careful leveling and alignment relative to each other, as well as proper alignment relative to a roller apron located below the mold in order to prevent excessive stresses in the cast metal strand as it emerged from the mold. In addition, it was difficult to obtain truly vertical linear reciprocal motion of the mold. Prior art mechanisms were typically heavy and therefore required massive support structures.

In conventional mold oscillators, the oscillating apparatus is in very close proximity to the mold, usually within the spray chamber. Alternatively, the oscillating apparatus includes massive pieces of machinery, generally utilizing a long radial arm connected to a distant center. Such devices are not only bulky, but are also difficult to maintain and repair, as well as to control accurately.

A spray chamber is a shielded area within which water sprays are directed onto the surface of the emerging continuous casting to cool the casting, which incidentally forms vast quantities of steam, obscuring the casting and close-by equipment from visual inspection and effectively preventing ordinary maintenance during operation.

It is well known that the oscillation of a continuous casting mold allow the attainment of high casting speeds and good surface quality of the continuous casting produced. During the downward stroke of the mold oscillation cycle, the mold is moved downwardly at approximately the casting speed, that is, at a rate of the number of inches per minute at which the casting is proceeding. The mold is then returned upwardly in the opposite direction of casting travel to its starting position at a much faster rate than its downward movement which completes the oscillation cycle. This cycle is repeated at a rate often as high as about 100 cycles per minute. The mold in a continuous casting machine is oscillated vertically when the mold has straight sides, or it can be oscillated arcuately along the path of curvature of the mold.

Presently available mold oscillating mechanisms utilize cam rolls or cam followers, which are arranged in cam roll banks movable in tracks. Trash, such as pieces of refractory, steel particles, splash, spatter, or any foreign matter that gets into the track on which the banks of cam rolls move, causes vibrations, wear, and damage to the cam roll banks and to bearings, which results in a frequent replacement requirement. The cam roll bank from a flexible unit, which is exposed to heat and steam, is difficult to lubricate on any regular basis, particularly during the casting operation.

Bota, Jr. et. al. in U.S. Pat. No. 3,881,544 recognize that molten metal spillage is a problem when it falls upon the mold oscillating system, which will usually cause damage. It should also be recognized that slag and other foreign matter frequently falls onto oscillating equipment which is located normally beneath the mold, causing difficulty in proper oscillation. In addition, the location of the oscillating equipment, both in its standard location and in the location espoused by Bota, is very difficult for maintenance personnel to work on during operation because of the proximity with the hot casting.

When utilizing an open-ended stationary mold, solidified metal tends to stick to the walls of the mold, making withdrawal of the casting from the mold difficult. This practice is extremely slow and results in castings of poor surface quality.

We have invented a mold oscillator mechanism for a continuous casting mold, either a straight or a curved mold. In addition, the oscillator mechanism is located exterior to the spray chamber and utilizes ball bushings in the oscillator guide to control the alignment of the oscillator. The bushings and the remainder of the oscillator mechanism are isolated from operations producing trash and other materials which interfere with effective operation of the oscillator.

OBJECTS OF THE INVENTION

It is an object of the present invention to provide a mold oscillator mechanism which is not subject to damage from slag, splash, spatter, break-out, or damage from material created by the continuous casting process.

It is another object of this invention to provide a mold oscillator mechanism which has an extremely accurate guide alignment.

It is another object of the present invention to provide a mold oscillating mechanism which reduces or eliminates strand misalignment.

It is another object of this invention to provide a mold oscillator mechanism which has a minimum number of moving parts.

It is another object of the present invention to provide a mold oscillating mechanism which has a rigid oscillator shaft.

It is another object of the invention to provide a mold oscillator mechanism for the continuous casting of metal which is capable of high speed production.

It is also an object of this invention to provide a mold oscillator mechanism which will assist in producing a continuous metal casting having excellent surface quality.

SUMMARY OF THE INVENTION

The invented oscillating mechanism includes a substantially closed tube having at least two bushings in which a vertically oscillatable shaft is engaged, with the lower end of the shaft adapted to be driven by an oscillator cam and the upper end of the shaft being connected to a mold table frame for oscillating a continuous casting mold in a vertical direction. The bushings are preferably ball bushings, which prevents lateral vibration of the vertical shaft and the associate mold table and mold. Since all parts of the mechanism connected directly to the vertical shaft move as a unit, in effect there is only one moving part other than the drive motor and the associated cam.

The oscillating mechanism of the present invention oscillates either a straight or a curved mold in a vertical direction. Heretofore it has been believed that the vertical oscillation of a curved mold would leave a mark on the casting at each oscillation where the discharge end of the mold digs into the upper surface of the discharging curved casting, which would result in unsatisfactory product. Experimentation has shown that a mark put on the casting by the mold does not appear in the finished product after rolling. This is a totally unexpected result.

DETAILED DESCRIPTION

Figure 1:
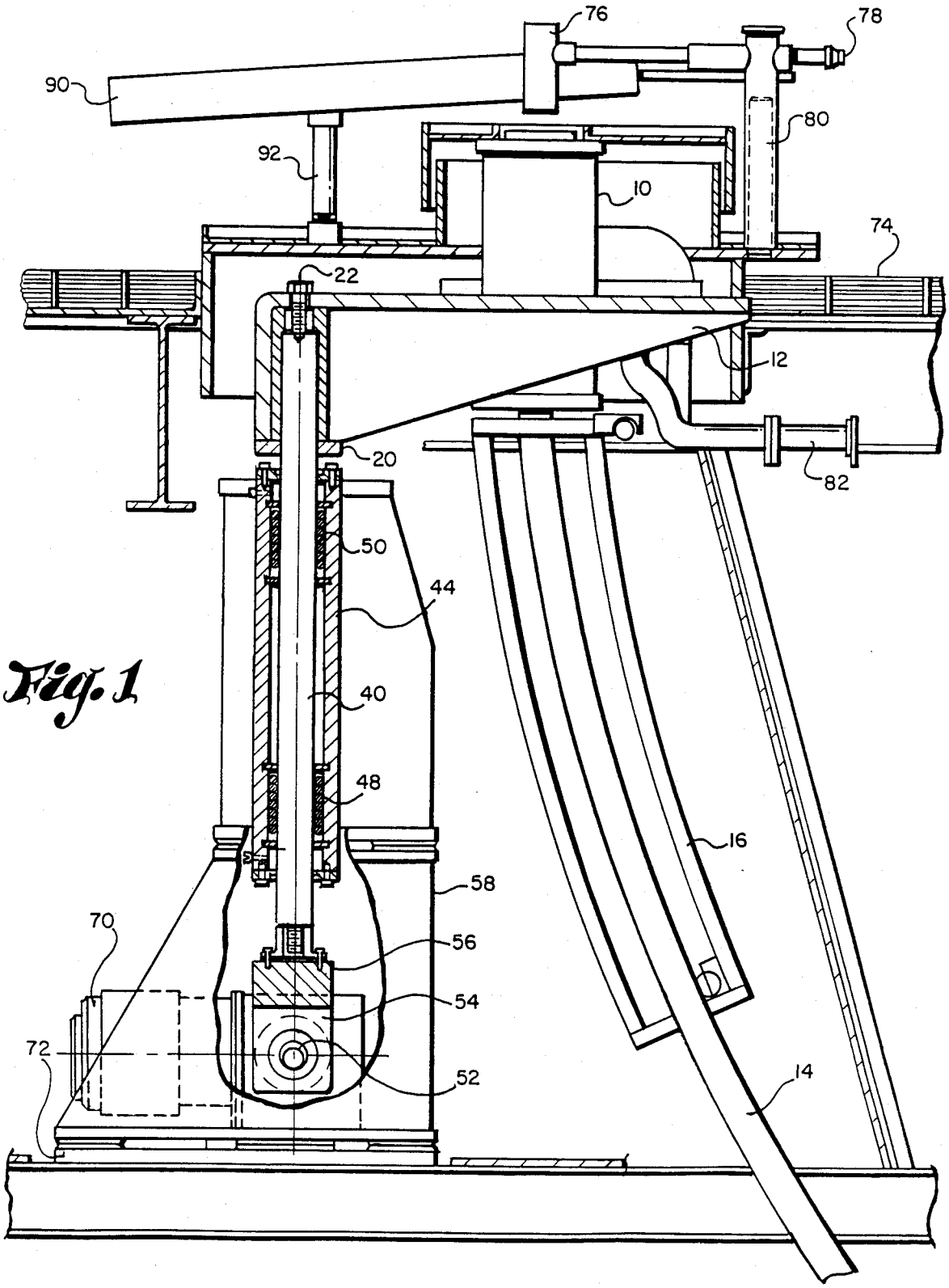
FIG. 1 is a side elevational view, partially cutaway, partially sectioned, of a curved mold continuous caster and oscillating mechanism.

Referring now to FIG. 1, a continuous casting mold 10 is fixed to a mold table frame or support 12. When the casting 14 emerges from the bottom of the mold, it follows an arcuate path, generally defined by pinch rolls and other supporting and guide rolls in a guide roll rack within coolant spray box 16, which are shown schematically in FIG. 1.

The mold oscillator has first and second vertical shafts 40 and 42 mounted within vertical shaft tubes 44 and 46 and supported by ball bushings 48 and 50, preferably at the upper and lower ends of the tube 44, but additional bushings can be mounted at intermediate elevations within each tube, as desired. Oscillator cam 52 rotates within oscillator yoke 54 which is connected to both of the vertical shafts 40 and 42 by a yoke adapter 56. The oscillator mechanism is preferably covered by a shield 58. The tube 44 or 46 is supported on upper and lower supports 60 and 62 external to the spray chamber. An upper shaft tube cover plate 64, carrying suitable sealing means such as O-ring 66 is fixed to the top of the vertical shaft tube, and a similar lower shaft tube cover plate 68 is attached to the lower end of the shaft tube. The seal between each cover plate and the vertical oscillator shaft prevents foreign material from coming into contact with the ball bushings. The only unshielded portion of the oscillator mechanism is the portion of the vertical shaft 40 exposed in the slight gap between upper shaft tube cover plate 60 and mold table frame flange 20, which gap is required to permit the full oscillating stroke distance, with some allowance for clearance.

A drive motor 70, supported by a base plate 72, is coupled to drive the oscillator cam 52. As the cam 52 is rotated, the oscillator shafts 40 and 42 travel in reciprocal vertical motion and impart linear reciprocal vertical motion through the mold table frame 12 to the mold 10. The oscillator mechanism is so positioned that the mold 10 extends above the casting floor 74. Molten metal is poured from a tundish, not shown, into the upper end of the mold 10 through a conventional pouring shroud 76. Nitrogen or other suitable inert gas is supplied to the pouring shroud 76 through gas inlet pipe 78. The pouring shroud 76 is supported by and pivotable about shroud support 80, which allows accurate positioning of the shroud for pouring, as well as rapid and easy removal of the shroud from the pouring position.

Cooling liquid, water for example, is provided to the mold and through the water inlet pipe 82. Additionally, spray water is provided to cool the casting 14 within coolant spray box 16 through suitably positioned nozzles, not illustrated.

As is conventional, a launder 90, supported by a suitable launder support 92, is rotated to a position above the mold 10 to divert molten metal from the mold 10 to a suitable disposal site in case the movement of the casting 14 is interrupted. This is a safety feature and is necessary because the tundish which normally supplies molten iron to the mold 10 through the pour tube 76 generally has no pouring control mechanism, but the result being that in case of a problem in the lower portions of the caster, such as a breakout of molten metal, any remaining molten metal within the tundish must be discharged into a disposal area.

Figure 2:
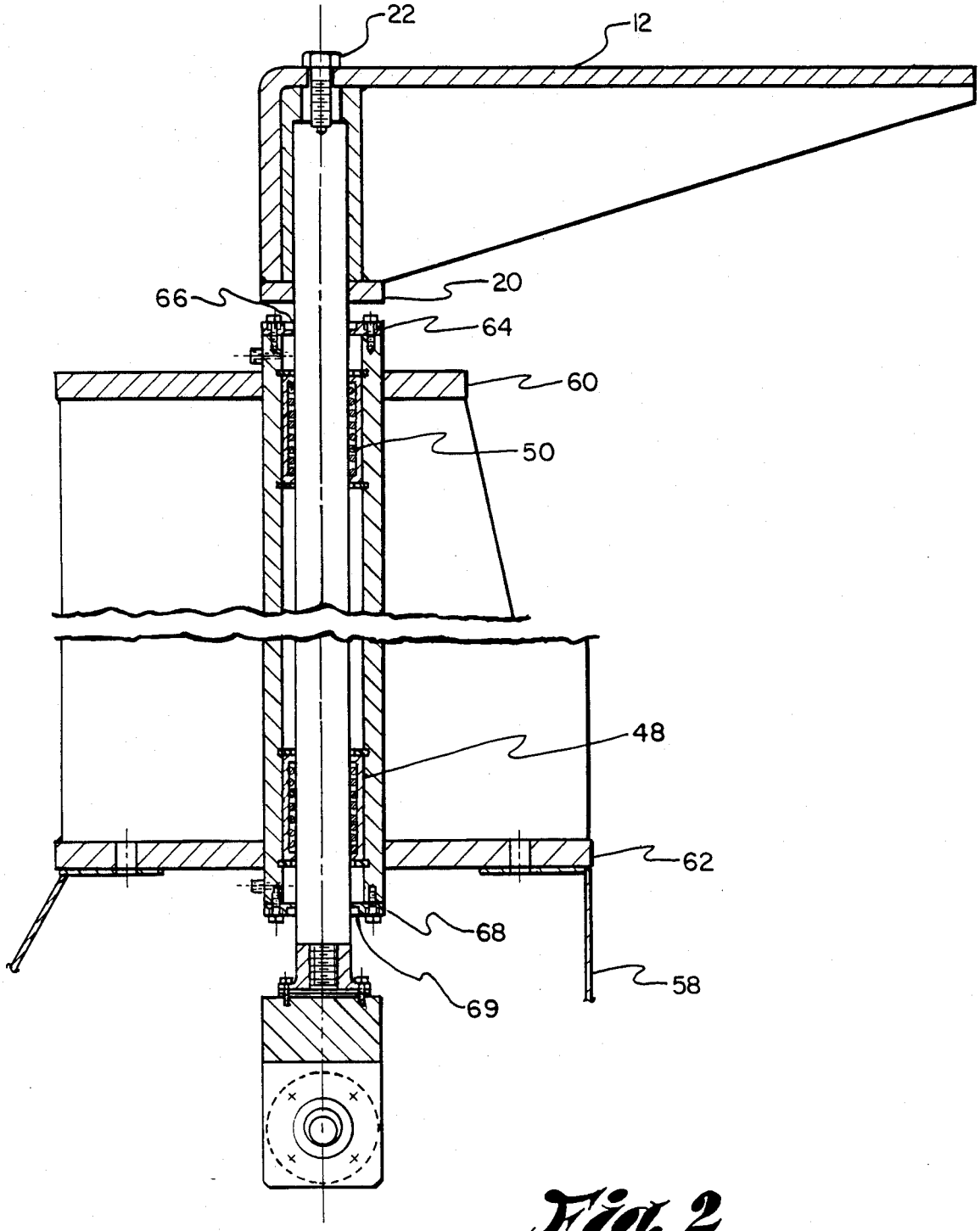
FIG. 2 is an enlarged sectional view of the oscillator shaft and tube of the oscillating mechanism of FIG. 1.
Figure 3:
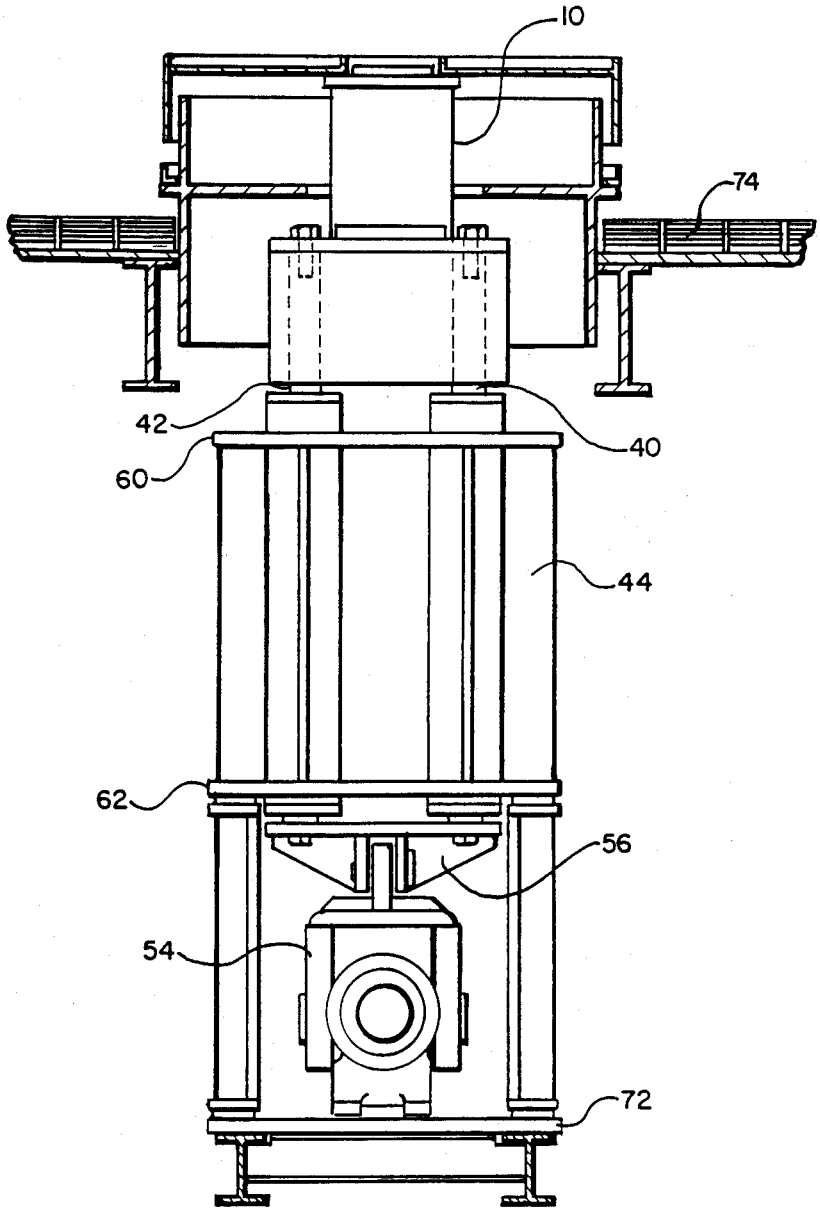
FIG. 3 is an end view of the oscillator and mold.

In operation, the mold table frame 12 is rigidly affixed to vertical shafts 40 and 42 as shown in FIG. 2, wherein the upper end of the vertical shaft is housed within mold table frame flange 20, and attached to the upper surface of mold table frame by means such as bolt 22. Shafts 40 and 42 are in turn rigidly held by roller bushings 48 and 50 with their movement limited to a vertical motion along the axis. This results in the mold 10 being restrained to a linear up and down motion as the casting 14 merges from the mold along an arcuate path terminating at the floor of the casting machine where suitable equipment is provided for cutting the casting 14 into appropriate lengths.

When the mold 10 is curved, it has been found that if the downward motion is selected such that it approximately equals the travel rate of the casting 14 and travels upward at a higher rate, that a casting having suitable surface characteristics is achieved. This is to be compared with prior art oscillators in which it was believed that it was necessary to oscillate curved molds along a curved line in order to achieve a casting 14 having the required surface finish.

The ball bushings 48 and 50 provide an extremely accurate alignment of the mold, and thus of the casting, as they cause the oscillator shafts to resist horizontal motion and lateral vibration. The ball bushings 48 and 50 may alternatively be roller bushings, or even conventional lubricated brass bushings, but the latter will hamper the operation of the invention considerably.

SUMMARY OF THE ACHIEVEMENTS OF THE OBJECTS OF THE INVENTION

From the foregoing, it is readily apparent that we have invented a mold oscillator mechanism for the continuous casting of metal which is not subject to damage from slag, splash, spatter, break-out, or damage from material created by the continuous casting process; which has an extremely accurate guide alignment, reducing or eliminating strand misalignment; which is capable of high speed production, and which will assist in producing a metal casting having excellent surface quality.

While there is illustrated and described the present preferred embodiment of the invention, it is to be understood that the invention is not limited thereto or thereby, but any changes or modifications within the scope of the following claims are included within the invention.

What is claimed is:

1. In a continuous casting machine in which a mold is mounted for vertical reciprocation on a mold table frame, said machine having an enclosed spray chamber beneath the mold for spray cooling of a continuous casting therein as it emerges from said mold, an improved mold oscillator mechanism comprising;

a drive motor;

an oscillator cam connected to said drive motor;

first and second vertical shafts fixed to said mold table frame at their upper ends; and means connected to said shafts for imparting vertical oscillatory motion to said shafts through said cam;

first and second vertical oscillator shaft guide means, said first and second shafts being seated within and vertically oscillatable within said guide means; each vertical oscillator shaft guide means comprising a vertical tube having at least a pair of vertically spaced bushings with said tube for seating, guideing and controlling the alignment of said shaft within said tube; and an upper tube cover plate fixed to the upper end of said tube and being provided with a central hole therethrough adapted for receiving said shaft therein.

2. Apparatus according to claim 1 further oomprising seal means seated in said upper tube cover plate for engaging said vertical shaft and forming a seal between said cover plate and said shaft.

3. Apparatus according to claim 1 wherein said means for imparting vertical motion to the oscillator shaft comprises an oscillator yoke engaging said cam and a yoke adaptor connecting said yoke to said first and second vertical shafts.

4. Apparatus according to claim 1 further comprising means for rigidly attaching said mold table frame to the upper end of said vertical shaft.

5. Apparatus according to claim 1 wherein said oscillator mechanism is located exterior to said spray chamber.

6. Apparatus according to claim 1 wherein said mold is curved.

7. Apparatus according to claim 1 wherein said mold is straight.

8. In a continuous casting machine in which a mold is mounted for vertical reciprocation on a mold table frame, said machine having an enclosed spray chamber beneath the mold for spray cooling of continuous casting therein as it emerges from said mold, an improved mold oscillator mechanism comprising;

a drive motor;

an oscillator cam connected to said drive motor;

first and second vertical shafts fixed to said mold table frame at their upper ends;

means connected to said shafts for imparting vertical oscillatory motion to said shafts through said cam;

first and second vertical oscillator shaft guide means, said first and second shafts being seated within and vertically oscillatable with said guide means, each vertical oscillator shaft guide means comprising a vertical tube having at least a pair of vertically spaced bushings with said tube for seating, guiding and controlling the alignment of said shaft within said tube; and an upper tube cover plate fixed to the upper end of said tube and being provided with a central hole therethrough adapted for receiving said shaft therein; and a lower tube cover plate fixed to the lower end of said tube and being provided with a central hole therethrough adapted for receiving said shaft therein.

9. Apparatus according to claim 8 further comprising seal means seated in said lower tube cover plate for engaging said vertical shaft and forming a seal between said lower cover plate and said shaft.

10. In a continuous casting machine in which a mold is mounted for vertical reciprocation on a mold table frame, said machine having an enclosed spray chamber beneath the mold for spray cooling of a continuous casting therein as it emerges from said mold, an improved mold oscillator mechanism comprising:

a drive motor;

an oscillator cam connected to said drive motor;

first and second vertical shafts fixed to said mold table frame at their upper ends;

means connected to said shafts for imparting vertical oscillatory motion to said shafts through said cam;

first and second vertical oscillator shaft guide means, said first and second shafts being seated within and vertically oscillatable within said guide means; and upper and lower shaft tube supports rigidly fixed to said vertical shaft tubes for supporting said tubes in a vertical position.

11. Apparatus according to claim 10 wherein said vertical oscillator shaft guide means comprises a vertical tube having at least a pair of vertically spaced bushings within said tube for seating guiding, and controlling the alignment of said shaft therein.

12. Apparatus according to claim 11 wherein said bushings are roller bushings.

13. Apparatus according to claim 11 wherein said bushings are ball bushings.

14. Apparatus according to claim 10 further comprising shield means surrounding substantially all of said oscillator mechanism.

* * * * *